US010263360B2

(12) United States Patent
Iwamoto

(10) Patent No.: US 10,263,360 B2
(45) Date of Patent: Apr. 16, 2019

(54) WATERPROOF CONNECTOR

(71) Applicant: Hosiden Corporation, Yao-shi, Osaka (JP)

(72) Inventor: Yuta Iwamoto, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 0 days.

(21) Appl. No.: 15/599,787

(22) Filed: May 19, 2017

(65) Prior Publication Data

US 2017/0346217 A1 Nov. 30, 2017

(30) Foreign Application Priority Data

May 26, 2016 (JP) ..... 2016-105176

(51) Int. Cl.
*H01R 13/52* (2006.01)
*H01R 13/506* (2006.01)

(52) U.S. Cl.
CPC ..... *H01R 13/5205* (2013.01); *H01R 13/506* (2013.01)

(58) Field of Classification Search
CPC ..... H01R 13/5205
USPC ..... 439/279
See application file for complete search history.

(56) References Cited

U.S. PATENT DOCUMENTS 5,588,858 A 12/1996 Lester et al.
5,645,451 A 7/1997 Ohsumi et al.
5,672,076 A 9/1997 Inaba et al.
2001/0055907 A1* 12/2001 Murakami ..... H01R 13/4365 439/595
2016/0093984 A1* 3/2016 Iwamoto ..... H01R 13/6581 439/607.55
2016/0248194 A1* 8/2016 Ii ..... H01R 13/4223
2017/0346217 A1* 11/2017 Iwamoto ..... H01R 13/5205

FOREIGN PATENT DOCUMENTS

EP 2475049 A1 7/2012
JP H0992385 A * 4/1997
JP 3292275 3/2002
JP 2011-175840 A 9/2011

OTHER PUBLICATIONS

European Search Report dated Sep. 15, 2017, 18 pages.

* cited by examiner

*Primary Examiner* — Abdullah A Riyami
*Assistant Examiner* — Nader J Alhawamdeh
(74) *Attorney, Agent, or Firm* — Rankin, Hill & Clark LLP

(57) ABSTRACT

A waterproof connector has a cable in which metal terminals are connected to the tip end, a housing that houses the metal terminals and a part of the cable, a packing in which a cable through hole that is passed to the front and rear sides is disposed, which is incorporated in the housing in a state where the packing is passed over the cable, and which ensures a watertightness between the cable and the housing, and a stopper in which a cable through hole that is passed to the front and rear sides is disposed, which is incorporated in the housing on a side of the packing opposite to the side of the metal terminals, in a state where the stopper is passed over the cable, and which holds the packing to the housing in a slipping-off preventing state.

3 Claims, 10 Drawing Sheets

WATERPROOF CONNECTOR

TECHNICAL FIELD

The present invention relates to a waterproof connector.

BACKGROUND ART

Conventionally, a waterproof connector has been known in which a sealing member for ensuring the watertightness of a wire portion is held to a housing by a holding member in a slipping-off preventing state (for example, see Patent Literature 1).

In the waterproof connector, the holding member and the sealing member in this sequence are firstly passed over an electric wire, the assembling process is then performed, and finally the sealing member and the holding member are incorporated in this order in the housing, with the result that the holding member in which one of a pair of engaging portions that are mutually engageable is disposed is fixed to the housing in which the other engaging portion is disposed, in a slipping-off preventing state where the one and other engaging portions are engaged with each other.

Here, the holding member has a front-back asymmetrical shape, and, in the case where the holding member is to be incorporated in the housing, must be therefore incorporated in a predetermined direction. In the case where the holding member is to be passed over the electric wire, moreover, the direction of the holding member is predetermined, and therefore particular attention must be paid to the direction in the process of being passed over the electric wire. When the assembling process is performed while the holding member is passed over the electric wire in a wrong direction, moreover, the member cannot be incorporated in the housing, and the product must be disassembled or discarded.

Consequently, the conventional waterproof connector has a problem in that the assemblability is poor.

PRIOR ART LITERATURE

Patent Literature

Patent Literature 1 Japanese Patent No. 3,292,275

SUMMARY OF THE INVENTION

Problem to be Solved by the Invention

The invention has been conducted in view of the problem. It is an object of the invention to provide a waterproof connector in which the assemblability is improved.

Means for Solving the Problem

1. A waterproof connector comprises: a cable in which metal terminals are connected to a tip end; a housing which houses the metal terminals and a part of the cable; a sealing member in which a cable through hole that is passed to front and rear sides is disposed, which is incorporated in the housing in a state where the sealing member is passed over the cable, and which ensures a watertightness between the cable and the housing; and a holding member in which a cable through hole that is passed to front and rear sides is disposed, which is incorporated in the housing on a side of the sealing member opposite to a side of the metal terminals, in a state where the holding member is passed over the cable, and which holds the sealing member to the housing in a slipping-off preventing state, engaging portions being disposed in the housing and the holding member, and engaged with each other to fix the holding member to the housing in a slipping-off preventing state, wherein the holding member is configured to have a front-back symmetrical shape.

According to the waterproof connector, the holding member is configured in a front-back symmetrical shape, and therefore can be used regardless of front or rear side, so that the holding member can be incorporated in the housing in either of the forward and rearward directions. Moreover, the holding member can be passed over the cable in either of the forward and rearward directions, and therefore it is not necessary to pay attention to the direction in the process of being passed over the cable. Furthermore, an error in which the holding member is passed over the cable in a wrong direction does not occur, and therefore the assemblability can be improved.

2. The waterproof connector according to the above first invention wherein the engaging portion on a side of the housing is an elastic arm which is projected from an inner wall of the housing, and the engaging portion on a side of the holding member is a groove which is disposed in an outer wall of the holding member, and has a pair of engaging surfaces configured by a pair of groove side walls that are opposed to each other in an axial direction of the cable through hole disposed in the holding member.

According to the waterproof connector, in the case where the holding member is passed over the cable from one of the front and rear sides, the elastic arm which is disposed on the housing is engaged with one engaging surface configured by one of the groove side walls of the groove which is disposed in the holding member, and, in the case where the holding member is passed over the cable from the opposite one of the front and rear sides, the elastic arm which is disposed on the housing is engaged with the other engaging surface configured by the other groove side wall of the groove which is disposed in the holding member. In each of the cases, the holding member can be fixed to the housing in a slipping-off preventing state, and the engaging portions having a simple shape enables the holding member to be fixed to the housing, in a slipping-off preventing state regardless of front or rear side.

3. The waterproof connector according to the above first or second invention wherein, in the holding member, a through hole which is passed to the front and rear sides is disposed in a periphery of the cable through hole.

According to the waterproof connector, it possible to, after the assembly, visually check the existence or nonexistence of the sealing member through the through hole which is disposed in the holding member.

4. The waterproof connector according to any one of the above first to third inventions wherein fitting portions which are to be fitted to each other to circumferentially position the holding member are disposed on the housing and the holding member, respectively, and the engaging portions are engaged with each other in a state where the fitting portions are fitted to each other.

According to the waterproof connector, the engaging portion on the side of the housing, and that on the side of the holding member can be surely engaged with each other, and the holding member can be fixed more surely to the housing in a slipping-off preventing state.

Effects of the Invention

The holding member is configured in a front-back symmetrical shape, and therefore can be used regardless of front or rear side, with the result that the assemblability can be improved.

BRIEF DESCRIPTION OF THE DRAWINGS

FIG. 5A is a front view, FIG. 5B is a plan view, and FIG. 5C is a sectional view taken along line A-A in FIG. 5A.

FIG. 6A is a front view, FIG. 6B is a plan view, and FIG. 6C is a right side view.

BEST MODE FOR CARRYING OUT THE INVENTION

Hereinafter, embodiments of the invention will be described with reference to the drawings. In an embodiment, a male waterproof connector 20 which is to be used in an electrical wiring of a vehicle, and in which a cable 10 is drawn out from the rear surface will be exemplified.

Figure 2:
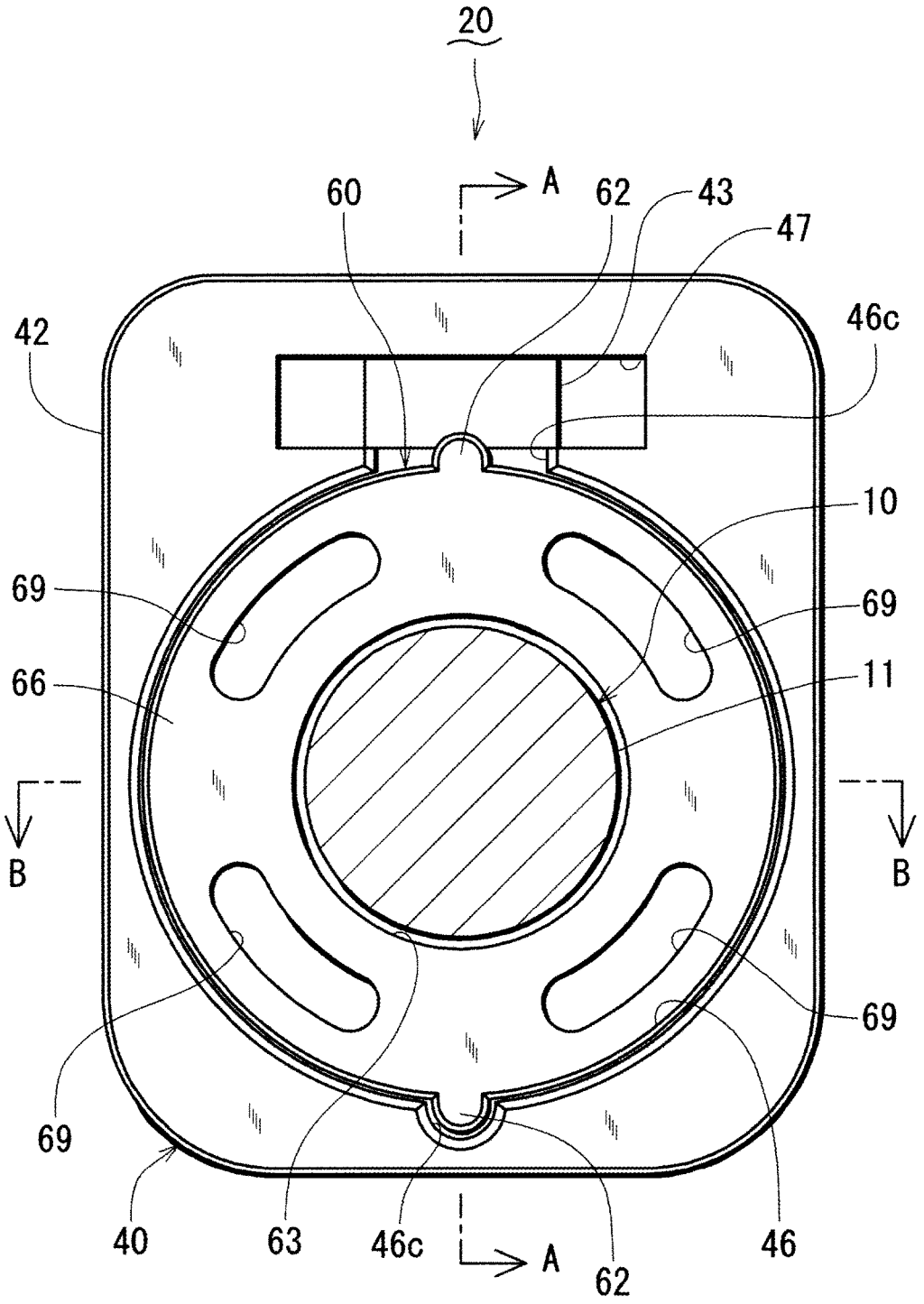
FIG. 2 is a back view of the waterproof connector of FIG. 1.

Hereinafter, it is assumed that the direction (the downward direction in the sheet of FIG. 3) in which the waterproof connector 20 is fitted to a counter connector is the forward direction, the opposite direction (the upward direction in the sheet of FIG. 3) is the rearward direction, the direction which is perpendicular to the fitting direction, and which extends along line A-A in FIG. 2 is the vertical direction (the height direction), and that which extends along line B-B in FIG. 2 that is perpendicular to line A-A is the lateral direction (the width direction).

Figure 1:
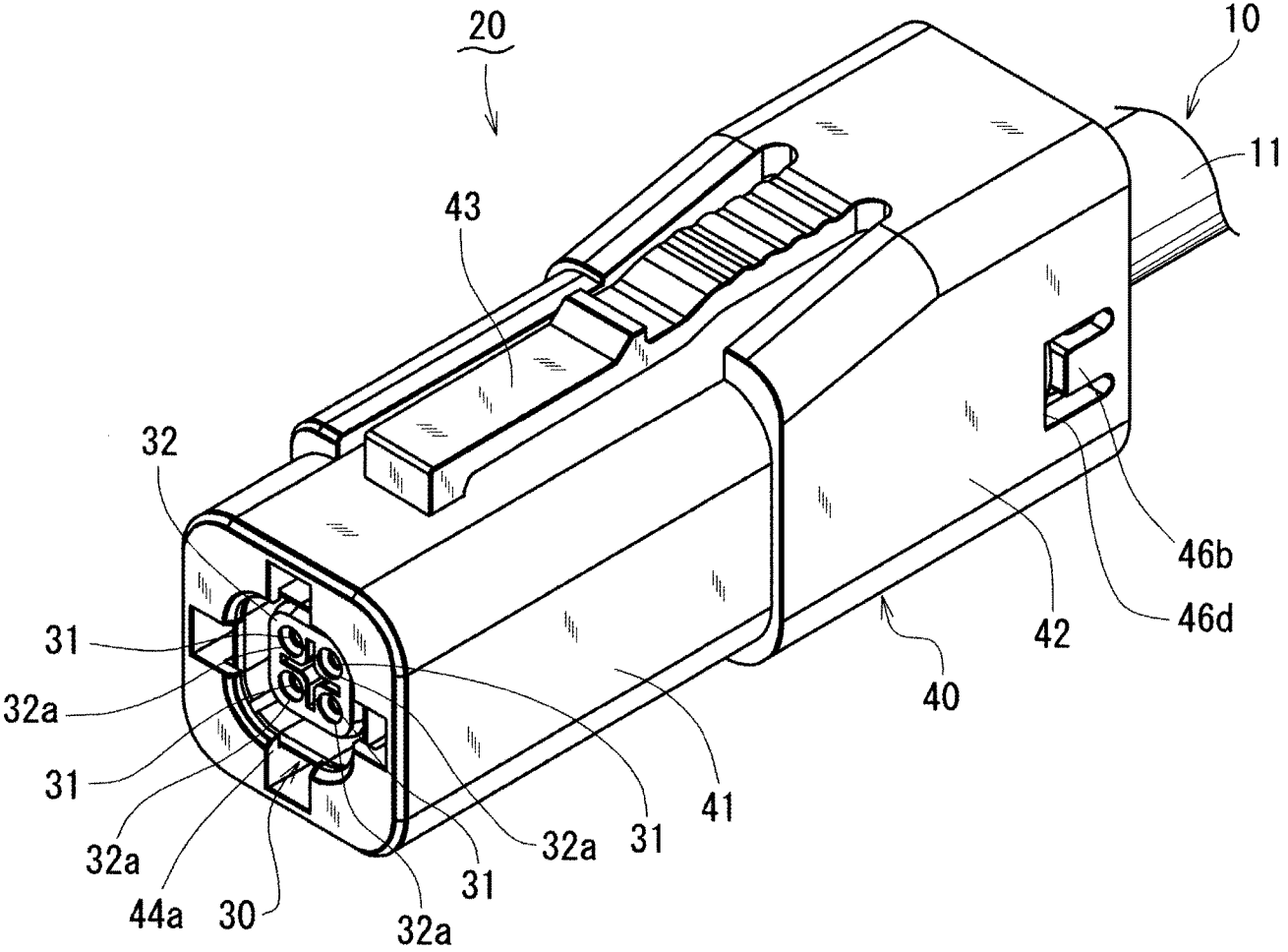
FIG. 1 is a perspective view of a waterproof connector of an embodiment of the invention.
Figure 3:
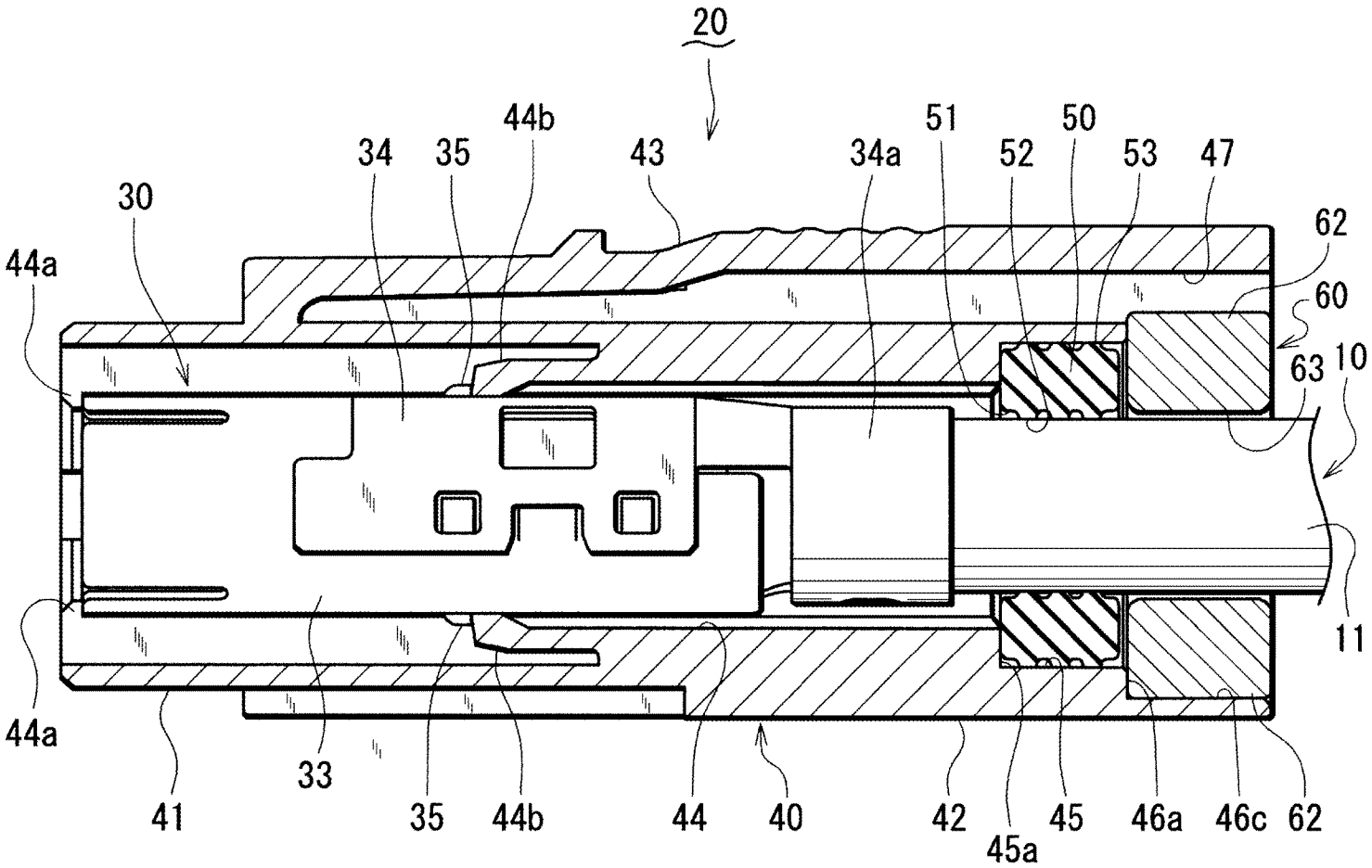
FIG. 3 is a partially sectional view taken along line A-A in FIG. 2.

As shown in FIGS. 1 to 3, the waterproof connector 20 is configured to have: the cable 10 in which a male connector body 30 is connected to the tip end; a male housing 40 which houses the connector body 30 and a part of the cable 10; an annular packing 50 which is incorporated in the housing 40 in a state where the packing is passed over the cable 10, and which functions as a sealing member that ensures the watertightness between the cable 10 and the housing 40; and an annular stopper 60 which is incorporated in the housing 40 on the rear side of the packing 50 that is opposite to the front side or on the side of the connector body 30, in a state where the stopper is passed over the cable 10, and which functions as a holding member that holds the packing 50 to the housing 40 in a slipping-off preventing state.

As shown in FIGS. 1 and 3, the connector body 30 is configured to have: a plurality (in the embodiment, four) of female metal terminals 31; a resin-made body 32 which holds the metal terminals 31 in a mutually insulated state; and a shield shell 33 and shell cover 34 which cover the outer circumference of the resin-made body 32.

The metal terminals 31 are formed by punching an electrically conductive metal plate into a predetermined shape, and then performing a bending process. A wire connecting portion which is not shown is disposed in each of the metal terminals 31 in a state where the portion is projected from the rear end of the terminal. The resin-made body 32 is formed by molding an insulating synthetic resin material. A plurality (in the embodiment, four) of terminal housing chambers 32*a* which respectively house the metal terminals are disposed in the resin-made body 32. The shield shell 33 is formed by punching an electrically conductive metal plate into a predetermined shape, and then performing a bending process. In the shield shell 33, a cable connecting portion which is not shown is disposed in a state where the portion is projected from the rear end. The shell cover 34 is formed by punching an electrically conductive metal plate into a predetermined shape, and then performing a bending process. In the shell cover 34, a cable connecting portion 34*a* is disposed in a state where the portion is projected from the rear end.

The cable 10 is configured to have a plurality (in the embodiment, four) of covered electric wires which are not shown, and a sheath 11 which covers a bundle of the covered electric wires. In a tip end portion of the cable 10, the sheath 11 is peeled off, and the covered electric wires are exposed, and moreover the insulating coatings of the covered electric wires are peeled off, so that the core wires (conductors) are exposed. The metal terminals 31 are connected to the tip ends of the electric wires in a state where the wire connecting portions of the metal terminals 31 are crimp- or solder-connected to the exposed core wires, respectively, so that the metal terminals 31 are connected to the tip end of the cable 10. The connector body 30 is connected to the tip end of the cable 10 in a state where the cable connecting portion of the shield shell 33 is crimp-connected to a tip end portion of the sheath 11, and the cable connecting portion 34*a* of the shield shell 33 is overlapped and crimp-connected to the outer side of the cable connecting portion.

The connector body 30 is assembled in following procedures (a) to (d).

(a) The metal terminals 31 are connected to the tip ends of the covered electric wires by crimp- or solder-connecting the wire connecting portions of the metal terminals 31 to the core wires of the covered electric wires which are previously exposed in the tip end portion of the cable 10, whereby the metal terminals 31 are connected to the tip end of the cable 10.

(b) The metal terminals 31 which are connected to the tip end of the cable 10 in (a) are inserted from the rear side into the terminal housing chambers 32*a* of the resin-made body 32, to be housed therein, and held in the resin-made body 32 in a mutually insulated state.

(c) The resin-made body 32 which holds the metal terminals 31 in a mutually insulated state in (b) is inserted from the rear side into the shield shell 33, to be housed therein, the resin-made body 32 is fixed into the shield shell 33 in a slipping-off preventing state, and then the cable connecting portion of the shield shell 33 is crimp-connected to a tip end portion of the sheath 11.

(d) The shell cover 34 is put from the upper side on a rear portion of the shield shell 33 in which the resin-made body 32 is housed and fixed in a slipping-off preventing state in (c), the shell cover 34 is engaged with and fixed to the shield shell 33, and then the cable connecting portion 34*a* of the shell cover 34 is overlapped and crimp-connected to the outer side of the cable connecting portion of the shield shell 33 which is crimp-connected to the tip end portion of the sheath 11 in (c).

The housing 40 is formed by molding an insulating synthetic resin material. The front half of the housing 40 is formed into a rectangular tubular shape and configured as a fitting portion 41 for a counter connector. The rear half of the housing 40 is formed into a rectangular tubular shape which is thicker than the fitting portion 41, and configured as a gripping portion 42 which, when the fitting portion 41 is to be inserted into or extracted from the counter connector, is to be held with the hand. A lock arm 43 for, when the fitting portion 41 is inserted and fitted into the counter connector, fixing the fitting portion 41 to the counter connector in a slipping-off preventing state is disposed on the upper surface of the housing 40 while bridging the upper surfaces of the fitting portion 41 and the gripping portion 42.

In the housing 40, in order from front to back, a connector body housing chamber 44 which houses the connector body 30 connected to the tip end of the cable 10, and which has a rectangular sectional shape; a packing housing chamber 45 which functions as a sealing member housing chamber that houses the cable 10 drawn out from the rear portion of the connector body 30, and the packing 50 passed over the cable, and which has a circular sectional shape; and a stopper housing chamber 46 which functions as a holding member housing chamber that houses the cable 10 drawn out from the rear portion of the connector body 30, and the stopper 60 passed over the cable, and which has a circular sectional shape are disposed. The connector body housing chamber 44, the packing housing chamber 45, and the stopper housing chamber 46 communicate with one another. The front end of the connector body housing chamber 44 is opened in the front end surface of the fitting portion 41 which is the front end surface of the housing 40, and the rear end of the stopper housing chamber 46 is opened in the rear end surface of the gripping portion 42 which is the rear end surface of the housing 40. A rectangular through hole 47 for enabling a gap which is on the side of the lower surface of the lock arm 43, to penetrate to an upper portion of the rear end surface of the gripping portion 42 is disposed in the region from the upper portion of the packing housing chamber 45 to that of the stopper housing chamber 46.

A connector body insertion stopper portion 44*a* is disposed in the edge of the front opening of the connector body housing chamber 44. In the case where the connector body 30 is to be inserted from the rear side into the connector body housing chamber 44 to be housed therein, the front end of the shield shell 33 which functions as the front end of the connector body 30 butts against the connector body insertion stopper portion 44*a*, thereby limiting further insertion of the connector body 30. A pair of engaging portions 44*b*, 35 are disposed on the housing 40 and the connector body 30, respectively. In the case where the connector body 30 is to be inserted from the rear side into the connector body housing chamber 44 to be housed therein, when the front end of the shield shell 33 butts against the connector body insertion stopper portion 44*a*, the engaging portions 44*b*, 35 are engaged with each other to fix the connector body 30 to the connector body housing chamber 44 in a slipping-off preventing state. The engaging portion 44*b* on the side of the housing 40 is configured by a cantilever-like elastic arm which is projected from the peripheral wall of the connector body housing chamber 44. The engaging portion 35 on the side of the connector body 30 is configured by projections which are disposed on the shield shell 33 and the shell cover 34, the rear end surfaces of the right and left side plates of the shell cover 34, and the like.

The packing housing chamber 45 has a circular sectional shape the diameter of which is larger than the connector body housing chamber 44 in which the front side has a rectangular sectional shape. A packing insertion limiting portion 45*a* which is a rearward-directed step surface is disposed between the connector body housing chamber 44 and the packing housing chamber 45. In the case where the packing 50 is to be inserted from the rear side into the packing housing chamber 45 to be housed therein, the front end of the packing 50 butts against the packing insertion limiting portion 45*a*, thereby limiting a further insertion of the packing 50.

Figure 4:
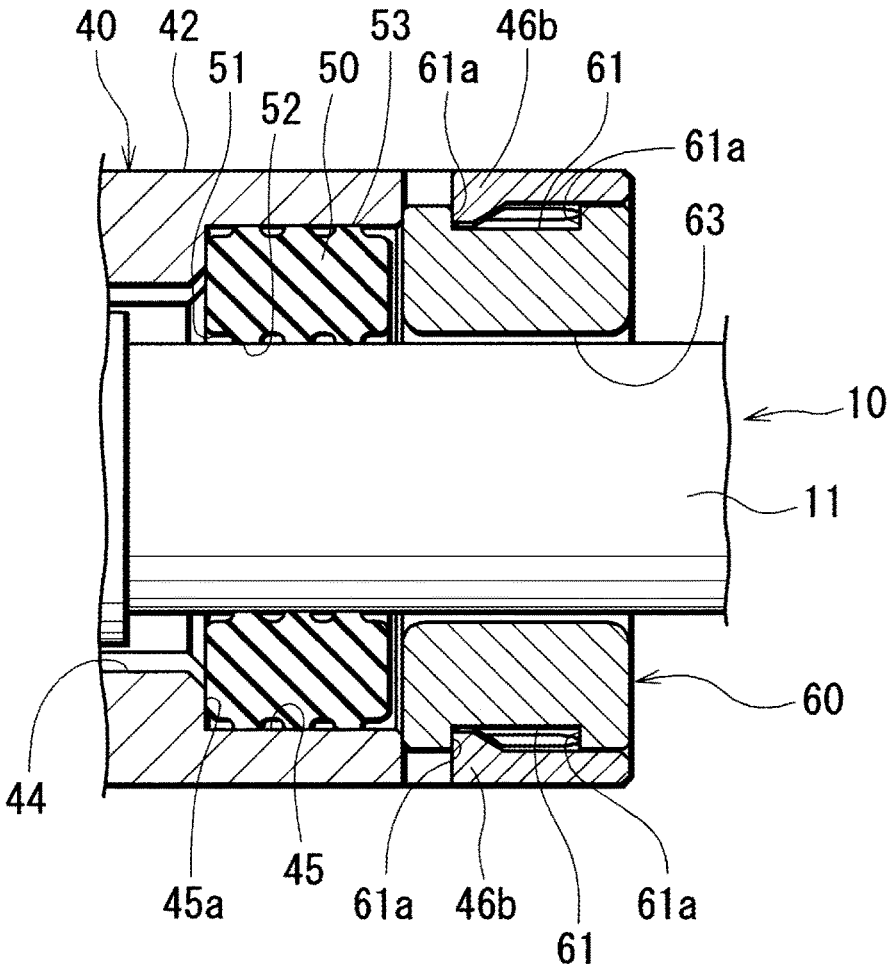
FIG. 4 is a partially sectional view taken along line B-B in FIG. 2.
Figure 5B:
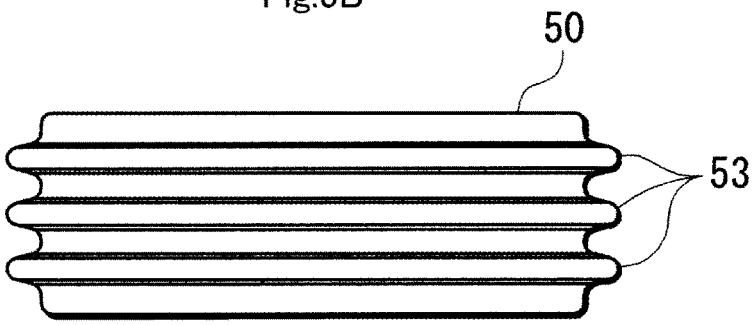
FIGS. 5A to 5C are views showing a packing.
Figure 5A:
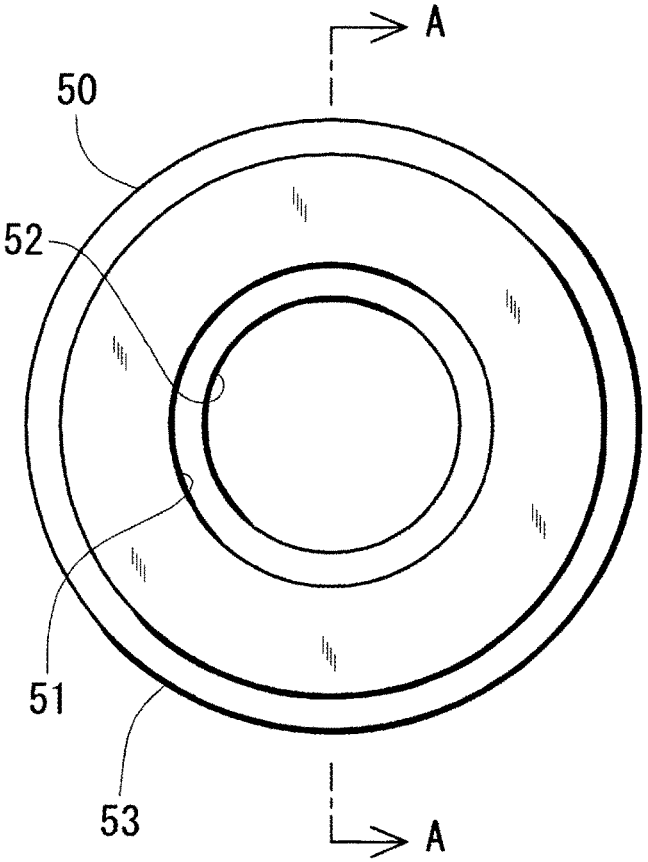
Figure 5C:
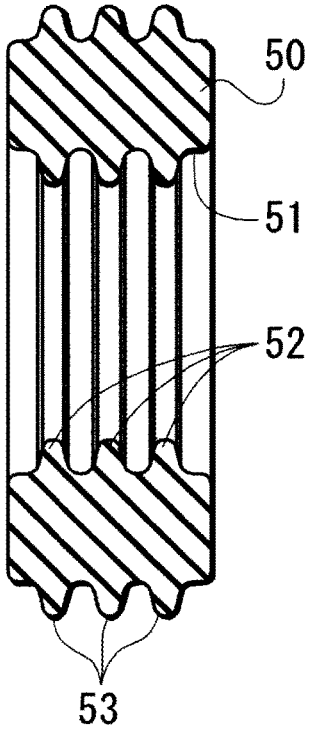
Figure 6B:
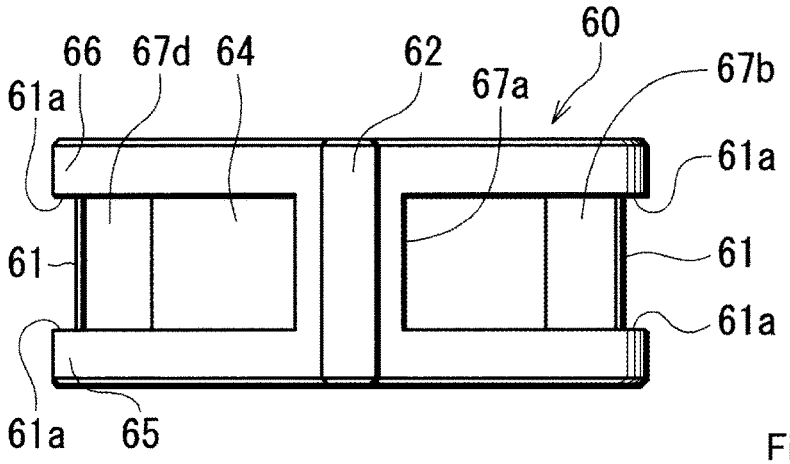
FIGS. 6A to 6C are views showing a stopper.
Figure 6A:
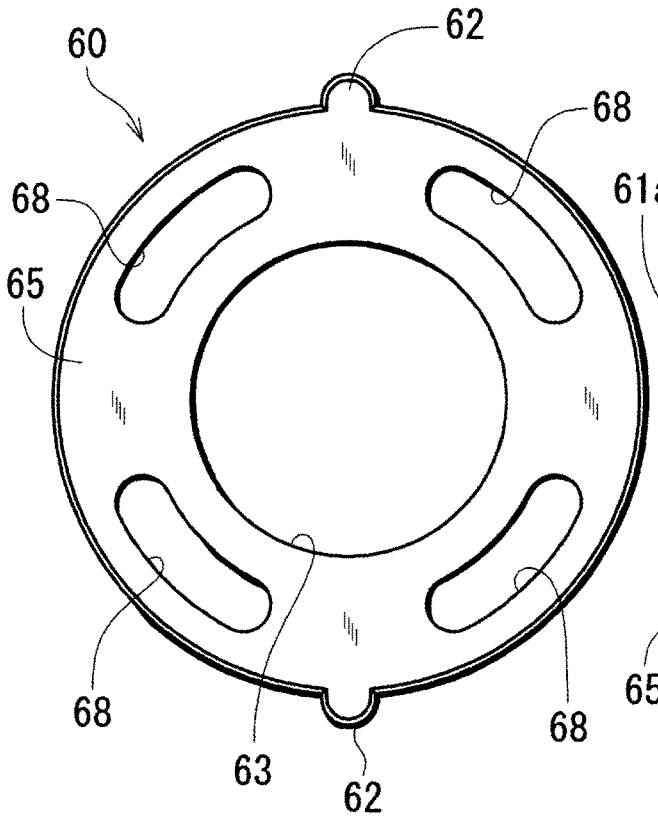
Figure 6C:
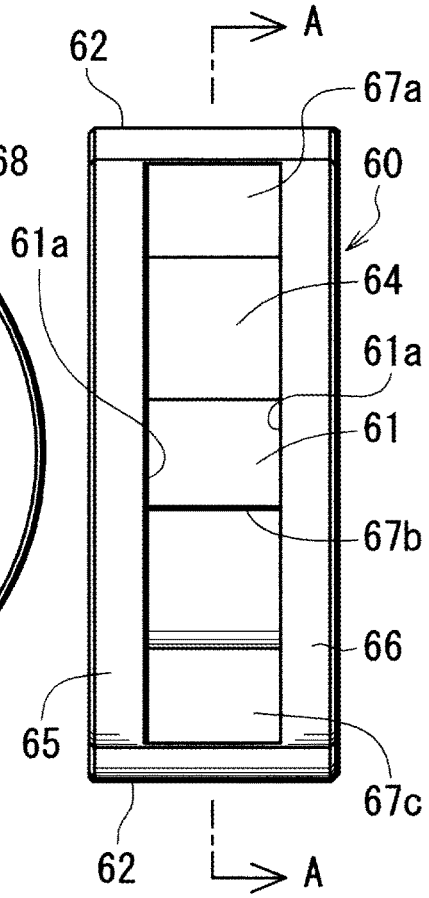
Figure 7:
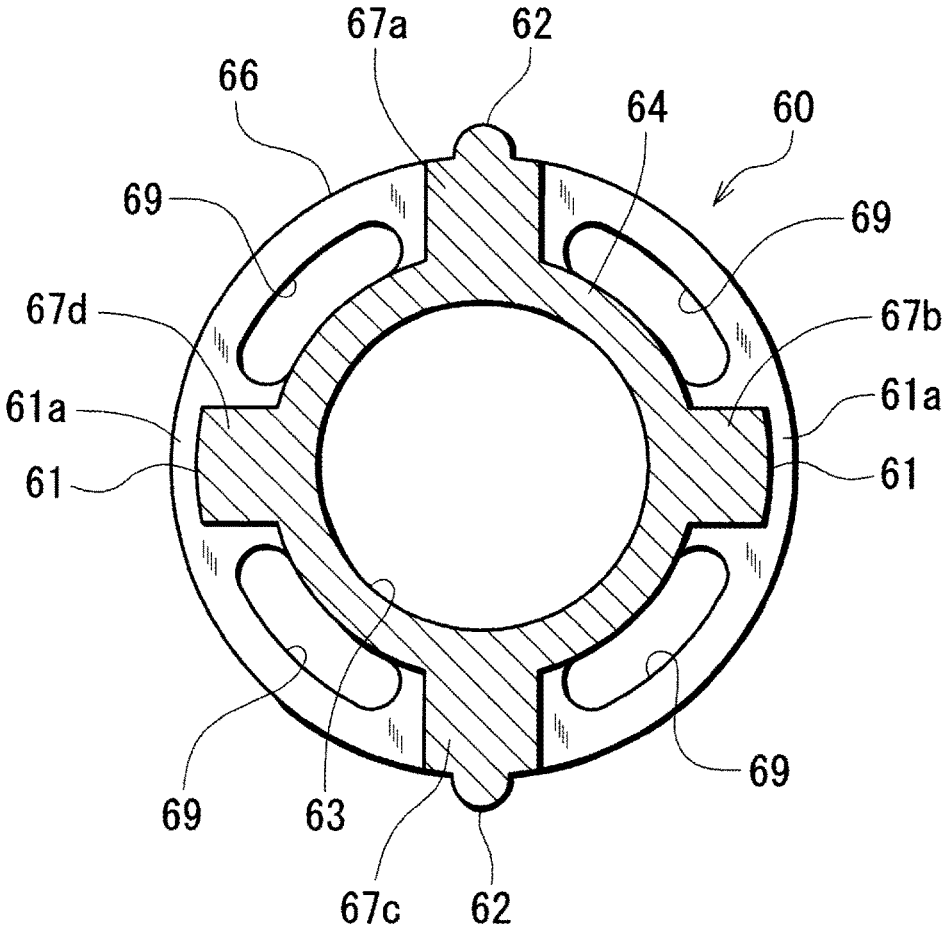
FIG. 7 is a sectional view taken along line A-A in FIG. 6C.

The front side of the stopper housing chamber 46 has a circular sectional shape the diameter of which is larger than the packing housing chamber 45 which has a circular sectional shape. A stopper insertion limiting portion 46*a* which is a rearward-directed step surface is disposed between the packing housing chamber 45 and the stopper housing chamber 46. In the case where the stopper 60 is to be inserted from the rear side into the stopper housing chamber 46 to be housed therein, the front end of the stopper 60 butts against the stopper insertion limiting portion 46*a*, and a further insertion of the stopper 60 is limited. As shown in FIG. 4, a pair of engaging portions 46*b*, 61 are disposed on the housing 40 and the stopper 60. In the case where the stopper 60 is to be inserted from the rear side into the stopper housing chamber 46 to be housed therein, when the front end of the stopper 60 butts against the stopper insertion limiting portion 46*a*, the pair of the engaging portions 46*b*, 61 are engaged with each other to fix the stopper 60 to the stopper housing chamber 46 in a slipping-off preventing state. As shown in FIG. 2, a pair of fitting portions 46*c*, 62 which, in the case where the stopper 60 is to be inserted from the rear side into the stopper housing chamber 46 to be housed therein, are fitted to each other to circumferentially position the stopper 60 are disposed on the housing 40 and the stopper 60. The pair of the engaging portions 46*b*, 61 are engaged with each other in a state where the fitting portions 46*c*, 62 are fitted to each other.

The packing 50 is formed in an annular shape by an elastic material such as a rubber. In a center portion of the packing 50, as shown in FIGS. 3 to 5, 8, and 9, a cable through hole 51 which is passed over the cable 10, and which can be in close contact with the outer circumferential surface of the sheath 11 of the cable is disposed while being passed to the front and rear sides, i.e., anteroposteriorly penetrating the packing. A plurality (in the embodiment, three) of inner circumferential lip portions 52 which are inwardly projected are juxtaposed in the anteroposterior direction on the circumferential surface (the inner circumferential surface of the packing 5) of the cable through hole 51. The inner circumferential lip portions 52 can be in close contact with the outer circumferential surface of the cable 10 in a liquid tight manner. Moreover, a plurality (in the embodiment, three) of outer circumferential lip portions 53 which are outwardly projected are juxtaposed in the anteroposterior direction on the outer circumferential surface of the packing 50. The outer circumferential lip portions 53 can be in close contact with the peripheral wall of the packing housing chamber 45 in a liquid tight manner.

Moreover, the packing 50 is configured in a front-back symmetrical shape, and therefore can be used regardless of front or rear side. More specifically, the packing 50 has a plane symmetrical structure in which a plane that is perpendicular to the axis of the cable through hole 51 is set as the symmetry plane.

The stopper 60 is formed into an annular shape by molding an insulating synthetic resin material. As shown in FIGS. 2 to 4 and 6 to 9, the stopper 60 is configured to have: a cable through hole 63 through which the cable 10 is passed while being passed to the front and rear sides, i.e., anteroposteriorly penetrating; a cylindrical portion 64 in which the cable through hole 63 functions as the inner hole; a pair of front and rear packing butting portions 65, 66 which are outwardly perpendicularly projected from the front and rear ends of the cylindrical portion 64, respectively, and which are opposed to each other in the axial direction of the cable through hole 63; reinforcement ribs 67*a* to 67*d* which are configured in a gap between the front and rear packing butting portions 65, 66, respectively by four thickened portions that are projected from the outer circumferential surface of the cylindrical portion 64 so as to form a cross shape as seen in the axial direction of the cable through hole 63; the engaging portions 61 which are on the side of the stopper 60, and which fix the stopper 60 to the stopper housing chamber 46 in a slipping-off preventing state; the fitting portions 62 which are on the side of the stopper 60, and which are used for circumferentially positioning the stopper 60; and a pair of front and rear through holes 68, 69 which are formed in the front and rear packing butting portions 65, 66. The pair of front and rear through holes 68, 69 are formed respectively in arcuate portions which are opposed to each other in the axial direction of the cable through hole 63 through a gap that is between corresponding adjacent two of the four reinforcement ribs 67*a* to 67*d*, and passed through arcuate portions to the front and rear sides, i.e., anteroposteriorly penetrate the arcuate portions.

Among the four reinforcement ribs 67*a* to 67*d*, the two vertical reinforcement ribs 67*a*, 67*c* extend to radially symmetrical positions where their tip end surfaces flush with the outer wall of the stopper 60 including the tip end surfaces of the front and rear packing butting portions 65, 66, respectively. Ridges which have a semicircular sectional shape, and which anteroposteriorly extend are disposed respectively on middle portions of the tip end surfaces of the two reinforcement ribs 67*a*, 67*c* that vertically extend. The ridges extend also onto the tip end surfaces of the front and rear packing butting portions 65, 66 so as to be disposed over the total thickness of the stopper 60. The ridges function as the fitting portions 62 which are on the side of the stopper 60, and which are used for circumferentially positioning the stopper 60. By contrast, a groove which has a substantially same shape as the pair of fitting portions 62 that are on the side of the stopper 60, and into which one of the fitting portions 62 is fittable is disposed at a lower one of two upper and lower positions where the vertical line (line A-A in FIG. 2) passing through the center of the stopper housing chamber 46 intersects the peripheral wall of the stopper housing chamber 46. At the upper position, a groove is disposed, which has a sectional shape larger than that of the pair of fitting portions 62 that are on the side of the stopper 60, and into which the other fitting portion 62 can be loosely fitted. The pair of upper and lower grooves function as the fitting portions 46*c* which are on the side of the housing 40, and which are used for circumferentially positioning the stopper 60. In a state where one of the fitting portions 62 on the side of the stopper 60 is positioned with respect to the lower fitting portion 46*c* on the side the housing 40, the stopper 60 is inserted from the rear side and housed into the stopper housing chamber 46, whereby the stopper 60 is positioned with respect to the stopper housing chamber 46 at the circumferential position where the four reinforcement ribs 67*a* to 67*d* are projected respectively from the outer circumferential surface of the cylindrical portion 64 so as to form a cross shape as seen in the axial direction of the cable through hole 63.

In the pair of fitting portions 46*c* disposed in the housing 40, and the pair of fitting portions 62 disposed in the stopper 60, as described above, it is not necessary to, when the stopper 60 is to be inserted from the rear side into the stopper housing chamber 46 and housed therein, simultaneously position the pair of fitting portions 62 on the side of the stopper 60 with respect to the pair of fitting portions 46*c* on the side of the housing 40. Therefore, the assemblability can be improved.

Among the four reinforcement ribs 67*a* to 67*d*, the two horizontal reinforcement ribs 67*b*, 67*d* extend to radially symmetrical positions, so that their tip end surfaces do not reach the tip end surfaces of the front and rear packing butting portions 65, 66, and they form recessed grooves in the outer wall of the stopper 60, respectively. The grooves are configured so that the tip end surfaces of the two reinforcement ribs 67*b*, 67*d* which horizontally extend are used as the groove bottoms, and parts of the front and rear packing butting portions 65, 66 which are outwardly projected from the front and rear ends of the groove bottoms, and which are opposed to each other in the axial direction of the cable through hole 63 are used as a pair of front and rear groove side walls. The grooves function respectively as the engaging portions 61 which are on the side of the stopper 60, and which fix the stopper 60 to the stopper housing chamber 46 in a slipping-off preventing state. Each of the engaging portions 61 has a pair of front and rear engaging surfaces 61*a* which are configured by the pair of front and rear groove side walls that are opposed to each other in the axial direction of the cable through hole 63. On the peripheral wall of the stopper housing chamber 46, at radial symmetrical positions which are opposed to the tip end surfaces of the two reinforcement ribs 67*b*, 67*d* of the stopper 60 that horizontally extend, by contrast, cantilever-like elastic arms (resin-made lances) are forwardly projected through U-like slits 46*d* that are rearwardly opened, from the peripheral wall of the stopper housing chamber 46. The pair of right and left elastic arms function respectively as the engaging portions 46*b* which are on the side of the housing 40, and which fix the stopper 60 to the stopper housing chamber 46 in a slipping-off preventing state. In the case where the stopper 60 is inserted from the rear side into the stopper housing chamber 46 and housed therein while fitting the fitting portions 62 on the side of the stopper 60 to the fitting portions 46*c* on the side of the housing 40, when the front surface (the front surface of the front packing butting portion 65) of the stopper 60 butts against the stopper insertion limiting portion 46*a*, the forwardly directed tip end surface of the engaging portion 46*b* on the side of the housing 40 is automatically engaged with the rearwardly directed engaging surface 61*a* of the engaging portion 61 on the side of the stopper 60 to fix the stopper 60 to the stopper housing chamber 46 in a slipping-off preventing state, whereby the packing 50 is held to the packing housing chamber 45 in a state where the packing is sandwiched between the packing insertion limiting portion 45*a* of the packing housing chamber 45 and the front surface of the stopper 60. The engaging surfaces 61*a* are engaged with the tip end surfaces of the engaging portions 46*b* in the portions which are opposed to the two reinforcement ribs 67*b*, 67*d*, respectively. Therefore, a load which is applied to the stopper 60 by pulling, prying, or the like of the cable 10 can be reduced. In a state where the packing 50 is held, moreover, the existence or nonexistence of the packing 50 can be visually checked through the pair of front and rear through holes 68, 69 which are opposed to each other in the axial direction of the cable through hole 63.

Moreover, the stopper 60 is configured in a front-back symmetrical shape, and therefore can be used regardless of front or rear side. More specifically, the stopper 60 has a plane symmetrical structure in which a plane that is perpendicular to the axis of the cable through hole 63 is set as the symmetry plane.

The embodiment has the above-described structure. The function of the embodiment will be described.

First, the waterproof connector 20 is assembled in following procedures (1) to (5). (1) The stopper 60 and the packing 50 are passed over the cable 10 in this sequence.

(2) The connector body 30 is assembled in procedures (a) to (d) above to the tip end of the cable 10 which is passed through the stopper 60 and the packing 50 in (1) above.

Figure 8:
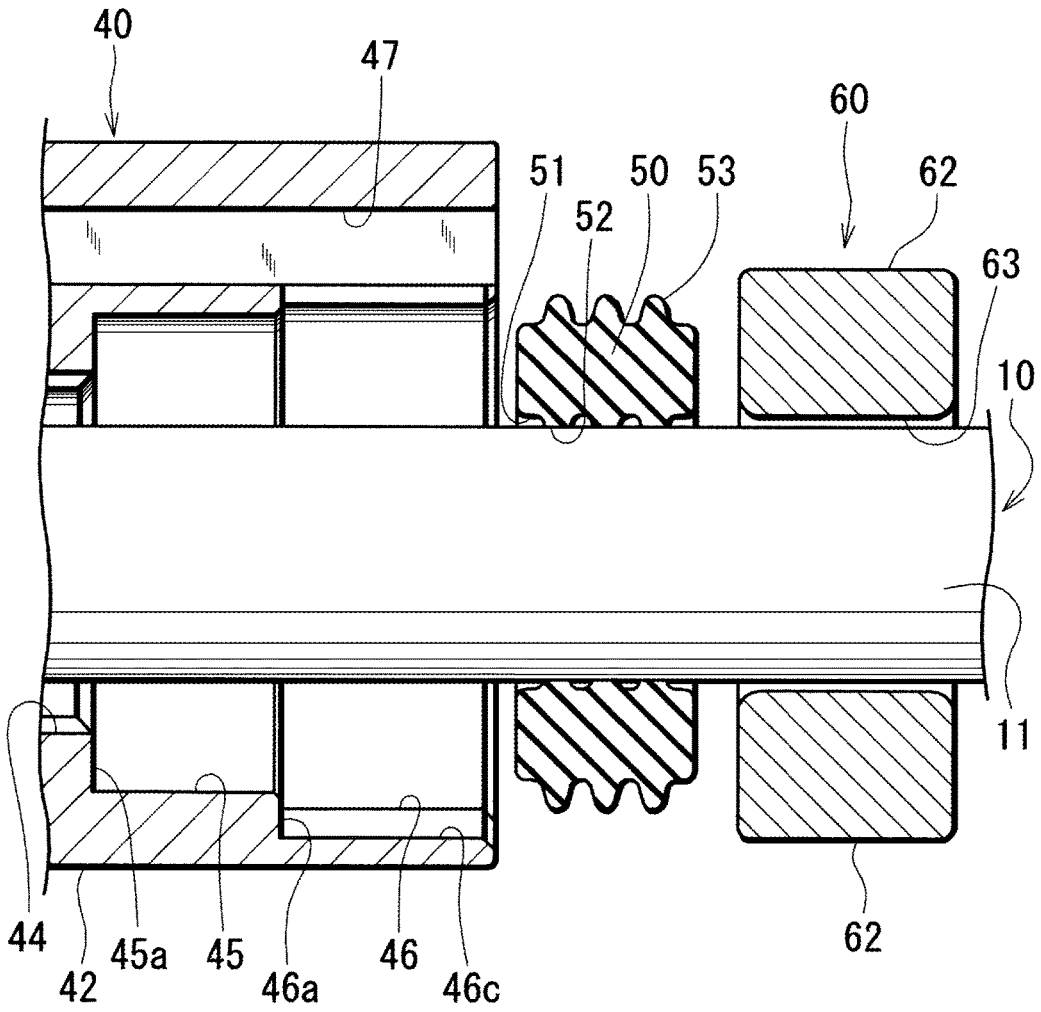
FIG. 8 is a partially sectional view taken along line A-A in FIG. 2 and showing a state where the packing and the stopper have not yet been incorporated in a housing.
Figure 9:
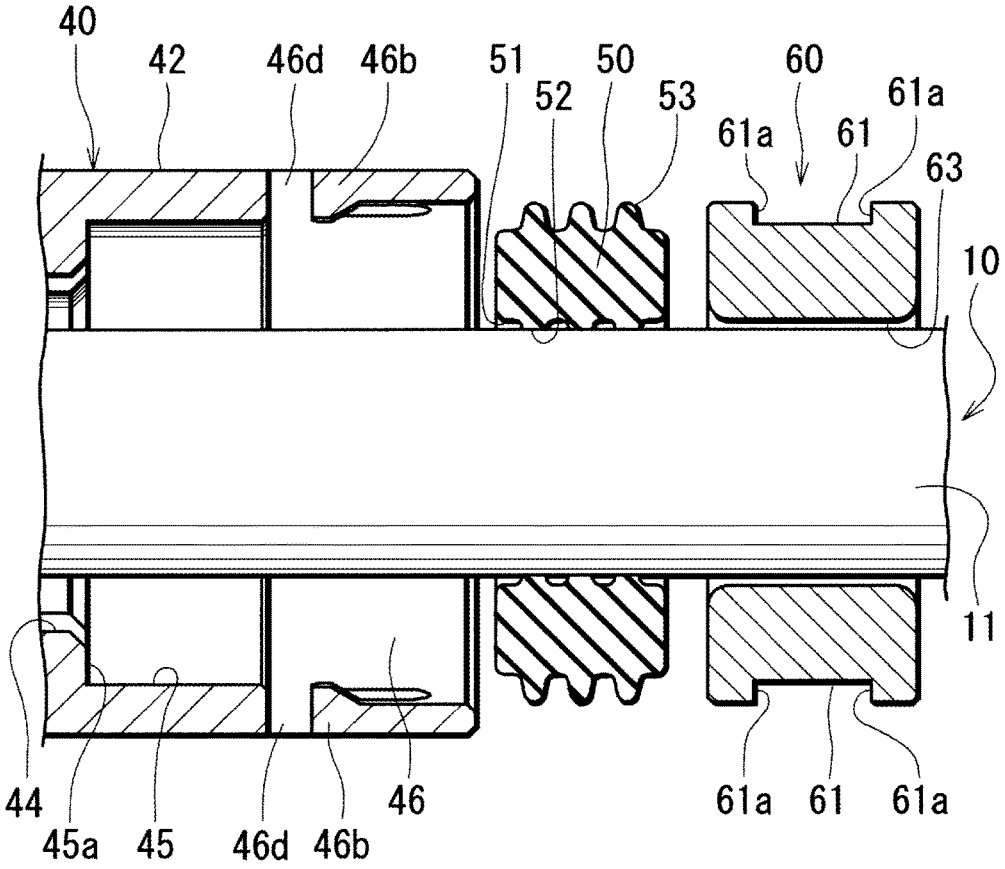
FIG. 9 is a partially sectional view taken along line B-B in FIG. 2 and showing the state where the packing and the stopper have not yet been incorporated in the housing.

(3) The connector body 30 which is connected to the tip end of the cable 10 in (2) is inserted from the rear side into the connector body housing chamber 44 of the housing 40 until the front end of the shield shell 33 of the connector body 30 butts against the connector body insertion stopper portion 44*a* of the connector body housing chamber 44, and housed therein. As shown in FIG. 3, the connector body 30 is fixed by the engaging portions 44*b*, 35 into the connector body housing chamber 44 of the housing 40 in a slipping-off preventing state. As shown in FIGS. 8 and 9, the cable 10 which is drawn out from the rear portion of the connector body 30 in (2) is further drawn out from the rear surface side of the housing 40 through the packing housing chamber 45 and stopper housing chamber 46 of the housing 40.

(4) While the packing 50 which is previously passed over the cable 10 in (1) is forwardly slid on the cable 10, the packing 50 is inserted from the rear side into the packing housing chamber 45 of the housing 40 until the front end of the packing 50 butts against the packing insertion limiting portion 45*a* of the packing housing chamber 45, and housed therein.

(5) While the stopper 60 which is previously passed over the cable 10 in (1) is forwardly slid on the cable 10, the stopper 60 is inserted from the rear side into the stopper housing chamber 46 of the housing 40 until the front surface of the stopper 60 butts against the stopper insertion limiting portion 46*a* of the stopper housing chamber 46, and housed therein. As shown in FIGS. 2 to 4, the stopper 60 is fixed into the stopper housing chamber 46 by the engaging portions 46*b*, 61 in a slipping-off preventing state, and the packing 50 is held in the packing housing chamber 45 in a state where the packing is sandwiched between the packing insertion limiting portion 45*a* of the packing housing chamber 45 and the front surface of the stopper 60.

In the waterproof connector 20 which is assembled as described above, the inner circumferential lip portions 52 of the packing 50 are in close contact with the outer circumferential surface of the cable 10 in a liquid tight manner, and the outer circumferential lip portions 53 of the packing 50 are in close contact with the peripheral wall of the packing housing chamber 45 in a liquid tight manner, whereby water or the like is prevented from entering from the outside into the connector body housing chamber 44 which is on the forward side.

According to the embodiment, as described above, in the waterproof connector 20 having: the cable 10 in which the metal terminals 31 are connected to the tip end; the housing 40 which houses the metal terminals 31 and a part of the cable 10; the packing 50 which functions as the sealing member, in which the cable through hole 51 that is passed to the front and rear sides is disposed, which is incorporated in the housing 40 in a state where the packing is passed over the cable 10, and which ensures the watertightness between the cable 10 and the housing 40; and the stopper 60 in which the cable through hole 63 that is passed to the front and rear sides is disposed, which is incorporated in the housing 40 of the packing 50 on the side opposite to the side of the metal terminal 31, in a state where the stopper is passed over the cable 10, and which functions as the holding member for holding the packing 50 to the housing 40 in a slipping-off preventing state, the engaging portions 46*b*, 61 being disposed in the housing 40 and the stopper 60, and engaged with each other to fix the stopper 60 to the housing 40 in a slipping-off preventing state, the stopper 60 is configured to have a front-back symmetrical shape. Therefore, the stopper 60 can be used regardless of front or rear side, so that the stopper can be incorporated in the housing 40 in either of the forward and rearward directions. Moreover, the stopper can be passed over the cable 10 in either of the forward and rearward directions, and therefore it is not necessary to pay attention to the direction in the process of being passed over the cable 10. Furthermore, an assembly error in which the stopper is passed over the cable 10 in a wrong direction does not occur, and therefore the assemblability can be improved.

Moreover, the engaging portions 46*b* on the side of the housing 40 are elastic arms which are projected from the inner wall of the housing 40. The engaging portions 61 on the side of the stopper 60 are grooves which are disposed in the outer wall of the stopper 60, and each of the engaging portions has the pair of engaging surfaces 61*a* configured by the pair of groove side walls that are opposed to each other in the axial direction of the cable through hole 63 disposed in the stopper 60. In the case where the stopper 60 is passed over the cable 10 from one of the front and rear sides, therefore, the elastic arms which are disposed on the housing 40 are engaged with one engaging surfaces 61*a* configured by one groove side walls of the grooves which are disposed in the stopper 60, and, in the case where the stopper 60 is passed over the cable 10 from the opposite one of the front and rear sides, the elastic arms which are disposed on the housing 40 are engaged with the other engaging surfaces 61*a* configured by the other groove side walls of the grooves which are disposed in the stopper 60. In each of the cases, the stopper 60 can be fixed to the housing 40 in a slipping-off preventing state, and fixed to the housing 40 by the engaging portions 46*b*, having a simple shape, in a slipping-off preventing state regardless of front or rear side.

In the stopper 60, the through holes 68, 69 which are passed to the front and rear sides are disposed in the periphery of the cable through hole 63. Therefore, it possible to, after the assembly, visually check the existence or nonexistence of the packing 50 through the through holes 68, 69 which are disposed in the stopper 60.

Moreover, the fitting portions 46*c*, 62 which are to be fitted to each other to circumferentially position the stopper 60 are disposed on the housing 40 and the stopper 60, and the engaging portions 46*b*, 61 are engaged with each other in a state where the fitting portions 46*c*, 62 are fitted to each other. Therefore, the engaging portions 46*b* on the side of the housing 40, and the engaging portions 61 on the side of the stopper 60 can be surely engaged with each other, and the stopper 60 can be fixed more surely to the housing 40 in a slipping-off preventing state.

Moreover, the packing 50 is configured in a front-back symmetrical shape, and therefore can be used regardless of front or rear side, so that the packing can be incorporated in the housing 40 in either of the forward and rearward directions. Consequently, the packing can be passed over the cable 10 in either of the forward and rearward directions, and therefore it is not necessary to pay attention to the direction in the process of being passed over the cable 10. Furthermore, an error in which the packing is passed over the cable 10 in a wrong direction does not occur, and therefore the assemblability can be improved.

Figure 10:
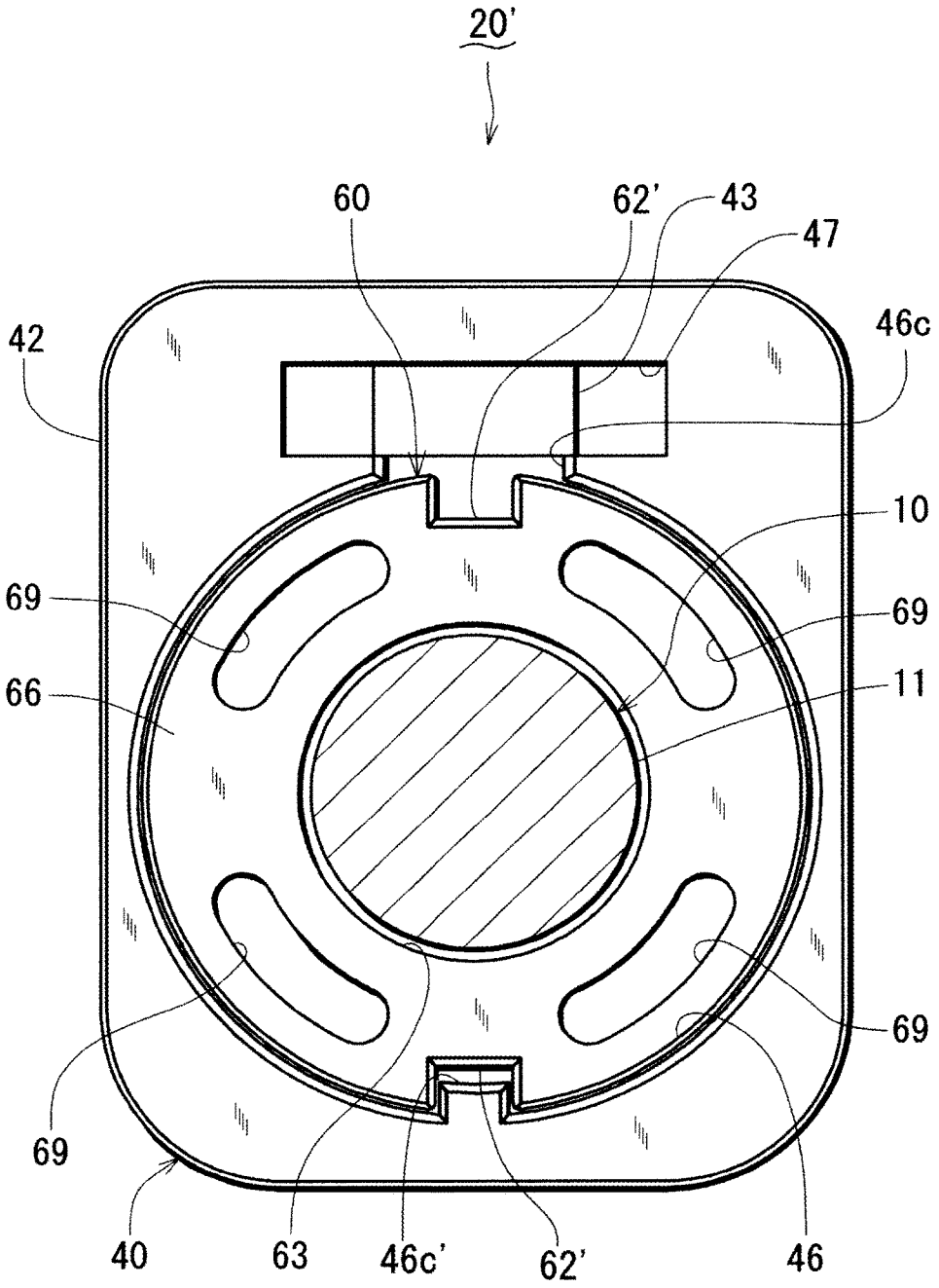
FIG. 10 is a back view of a waterproof connector of another embodiment of the invention.

FIG. 10 is a back view (corresponding to FIG. 2) of a waterproof connector 20' of another embodiment of the invention. In the waterproof connector 20 shown in FIGS. 1 to 9, the fitting portions 62 which are configured by the ridges are disposed on the side of the stopper 60, and the fitting portions 46*c* which are configured by the grooves are disposed on the side of the housing 40. In the waterproof connector 20' shown in FIG. 10, by contrast, fitting portions 62' which are configured respectively by grooves are disposed on the side of the stopper 60, and a fitting portion 46*c'* which is configured by a ridge is disposed on the side of the housing 40. The waterproof connector 20' shown in FIG. 10 is structured in the same manner as the waterproof connector 20 shown in FIGS. 1 to 9 except the structure of the fitting portion for circumferentially positioning the stopper 60.

DESCRIPTION OF REFERENCE NUMERALS

10 cable
20 waterproof connector
31 metal terminal
40 housing
46*b*, 61 engaging portion
46*c*, 62, 46*c'*, 62' fitting portion
50 packing (sealing member)
51 cable through hole
60 stopper (holding member)
61*a* engaging surface
63 cable through hole
68, 69 through hole

The invention claimed is:

1. A waterproof connector comprising: a cable in which metal terminals are connected to a tip end; a housing which houses the metal terminals and a part of the cable; a sealing member in which a cable through hole is passed to front and rear sides, which is incorporated in the housing in a state where the sealing member is passed over the cable, and which ensures a watertightness between the cable and the housing; and a holding member in which the cable through hole that is passed to front and rear sides is disposed, which is incorporated in the housing on a side of the sealing member opposite to a side of the metal terminals, in a state where the holding member is passed over the cable, and which holds the sealing member to the housing in a slipping-off preventing state, engaging portions being disposed in the housing and the holding member, and engaged with each other to fix the holding member to the housing in a slipping-off preventing state, wherein the holding member is configured to have a front-back symmetrical shape, the engaging portion on a side of the housing is an elastic arm which is projected from an inner wall of the housing, and the engaging portion on a side of the holding member is a groove which is disposed in an outer wall of the holding member, and has a pair of engaging surfaces configured by a pair of groove side walls that are opposed to each other in an axial direction of the cable through hole disposed in the holding member.

2. A waterproof connector comprising: a cable in which metal terminals are connected to a tip end; a housing which houses the metal terminals and a part of the cable; a sealing member in which a cable through hole is passed to front and rear sides, which is incorporated in the housing in a state where the sealing member is passed over the cable, and which ensures a watertightness between the cable and the housing; and a holding member in which the cable through hole that is passed to front and rear sides is disposed, which is incorporated in the housing on a side of the sealing member opposite to a side of the metal terminals, in a state where the holding member is passed over the cable, and which holds the sealing member to the housing in a slipping-off preventing state, engaging portions being disposed in the housing and the holding member, and engaged with each other to fix the holding member to the housing in a slipping-off preventing state, wherein the holding member is configured to have a front-back symmetrical shape, and, in the holding member, a through hole which is passed to the front and rear sides is disposed in a periphery of the cable through hole, wherein the engaging portion on a side of the housing is an elastic arm which is projected from an inner wall of the housing, and the engaging portion on a side of the holding member is a groove which is disposed in an outer wall of the holding member, and has a pair of engaging surfaces configured by a pair of groove side walls that are opposed to each other in an axial direction of the cable through hole disposed in the holding member.

3. A waterproof connector comprising: a cable in which metal terminals are connected to a tip end; a housing which houses the metal terminals and a part of the cable; a sealing member in which a cable through hole is passed to front and rear sides, which is incorporated in the housing in a state where the sealing member is passed over the cable, and which ensures a watertightness between the cable and the housing; and a holding member in which the cable through hole that is passed to front and rear sides is disposed, which is incorporated in the housing on a side of the sealing member opposite to a side of the metal terminals, in a state where the holding member is passed over the cable, and which holds the sealing member to the housing in a slipping-off preventing state, engaging portions being disposed in the housing and the holding member, and engaged with each other to fix the holding member to the housing in a slipping-off preventing state, wherein the holding member is configured to have a front-back symmetrical shape, fitting portions which are fitted to each other to circumferentially position the holding member are disposed in the housing and the holding member, respectively, and the engaging portions are engaged with each other in a state where the fitting portions are fitted to each other, wherein the engaging portion on a side of the housing is an elastic arm which is projected from an inner wall of the housing, and the engaging portion on a side of the holding member is a groove which is disposed in an outer wall of the holding member, and has a pair of engaging surfaces configured by a pair of groove side walls that are opposed to each other in an axial direction of the cable through hole disposed in the holding member.

* * * * *